United States Patent [19]

Kuznetsov et al.

[11] Patent Number: 4,693,299

[45] Date of Patent: Sep. 15, 1987

[54] CONTINUOUS METAL CASTING APPARATUS

[75] Inventors: Stephen B. Kuznetsov, Washington, D.C.; Richard D. Nathenson, Pittsburgh, Pa.

[73] Assignee: Westinghouse Electric Corp., Pittsburgh, Pa.

[21] Appl. No.: 871,005

[22] Filed: Jun. 5, 1986

[51] Int. Cl.[4] ..... B22D 11/00; B22D 27/02

[52] U.S. Cl. ..... 164/502; 164/420; 164/440

[58] Field of Search ..... 164/440, 466, 490, 500, 164/502, 420

[56] References Cited

U.S. PATENT DOCUMENTS

| | | | |
|---|---|---|---|
| 2,448,008 | 8/1948 | Baker et al. | 219/10.61 R |
| 2,448,009 | 8/1948 | Baker et al. | 219/10.41 |
| 2,448,010 | 8/1948 | Baker et al. | 219/10.51 |
| 2,448,011 | 8/1948 | Baker et al. | 219/10.41 |
| 2,448,012 | 8/1948 | Baker et al. | 219/10.51 |
| 3,646,988 | 3/1972 | Getselev | 164/467 |
| 3,735,799 | 5/1973 | Karlson | 164/504 |
| 3,811,490 | 5/1974 | Middleton et al. | 164/504 |
| 3,939,799 | 2/1976 | Kanbara et al. | 118/620 |
| 3,947,533 | 3/1976 | Davis | 164/467 |
| 3,952,791 | 4/1976 | Ito et al. | 164/504 |
| 3,995,678 | 12/1976 | Zavaras et al. | 164/504 |
| 4,042,007 | 8/1977 | Zavaras et al. | 164/504 |
| 4,042,008 | 8/1977 | Alberny et al. | 164/504 |
| 4,103,730 | 8/1978 | Dussart | 164/504 |
| 4,414,285 | 11/1983 | Lowry et al. | 164/467 |
| 4,424,856 | 1/1984 | Onoda et al. | 164/504 |
| 4,450,892 | 5/1984 | Heinemann et al. | 164/467 |
| 4,454,909 | 6/1984 | Mulcahy | 164/504 |
| 4,462,458 | 7/1984 | Ruer | 164/504 |
| 4,540,037 | 9/1985 | Langner | 164/440 |
| 4,566,526 | 1/1986 | Fastert et al. | 164/490 |

*Primary Examiner*—Nicholas P. Godici
*Assistant Examiner*—Richard K. Seidel
*Attorney, Agent, or Firm*—C. M. Lorin

[57] ABSTRACT

In a continuous casting vessel, the gap between the feed column of molten metal and the mold inlet port is electromagnetically sealed by applying polyphase current on the edge of the inlet port to form therewith an integral inductor effective to contain the metal in the pool about the meniscus at the base of the feed column in the sunk nozzle.

11 Claims, 8 Drawing Figures

CONTINUOUS METAL CASTING APPARATUS

BACKGROUND OF THE INVENTION

The invention relates to continuous casting of molten metal in general and more particularly to an electromagnetic seal adapted to confine the molten metal within the mold at the inlet of feeding material for the casting vessel.

It is generally known to use electromagnetic forces generated with an electrical coil in order to induce forces in the molten metal of continuous casting apparatus for stirring as well as for levitating the molten metal. Such forces result from the interaction of the magnetic field from the coil and eddy currents induced in the metal.

It is known from U.S. Pat. No. 3,646,988 to apply an annular electromagnetic coil around the pouring and solidification zones of molting metal in order to prevent flowing as well as for shaping solidified metal in a continuous casting process.

It is known from U.S. Pat. No. 3,939,799 to generate electromagnetic forces with an electromagnet in order to prevent molten metal from leaking out at the strip feeding end of a plating tank.

It is known from U.S. Pat. No. 3,735,799 to produce with single phase alternating current an electromagnetic alternating field around the melting column under continuous casting in order to hold together laterally the metal without spreading and without mold walls.

It is known from U.S. Pat. No. 4,450,892 in a horizontal continuous casting installation to provide an electromagnetic coil in a zone of discontinuity in the mold of molten metal, especially where the casting vessel has a nozzle-like connecting portion, in order to generate electromagnetic forces along such connecting portion to accelerate metal flow and maintain a stable meniscus. In such instance, polyphase current is used so as to produce a travelling electromagnetic wave.

It is known from U.S. Pat. No. 4,414,285 to use polyphase currents passing in a plurality of coils to push or pull a column of metal combining molten and solidified metal at the outlet of a casting vessel.

SUMMARY OF THE INVENTION

The invention resides in an annular electromagnetic indicator integral with the casting vessel of continuous metal casting apparatus, disposed at the inlet where the feeding nozzle penetrates into the molten metal bath of the mold. Polyphase alternating current is injected in the inductor portion of the casting vessel so as to generate constricting forces in the metal where there is a gap between the inlet surface and the vertical nozzle.

Protruding vertical leads are provided which are connected to, and preferably integral with, the annular inductor at the regularly distributed nodal points of the polyphase AC input.

As a result, the annular inductor is an integral part of the casting vessel fulfilling the mold of an induction coil, but having all the advantages of a nondiscontinuous piece working as a unit in proximity to the meniscus of molten extending from underneath the lid of the casting vessel near the edge of the outlet to the outside surface of the nozzle maintaining a column of molten metal thereabove.

More specifically, the invention is applicable to a continuous casting vessel which is associated with back and forth alternative and horizontal motions to facilitate the extraction process for the solidified metal from the outlet of the vessel. In such process, known as horizontal-cast continuous casting, the casting vessel has two opposite outlets disposed laterally for pulling out solid billets of solidified metal.

Accordingly, the inlet of molten metal being continuously poured down through an upper and central inlet by the feeding nozzle, defines an asymmetrical gap between the inner surface of the inlet and the outer surface of the nozzle. Horizontal and alternative movements of the casting vessel effectuate limited displacements creating a minimum and a maximum gap alternately on opposite sides of the nozzle. The provided integral inductor surrounding the gap prevents any leakage of molten metal and operates as a seal therefor.

DESCRIPTION OF THE PREFERRED EMBODIMENTS

In continuous casting, molten metal is extracted from a tundish, or reservoir, and fed vertically through a vertical nozzle into a pool contained in a vessel which is the primary mold. At the same time as molten metal is being poured at the top inlet port into the mold, solidified metal is extracted in the form of a billet, or strip, from one or more outlet ports at the bottom, or laterally of the mold.

In order to insure rapid solidification during the metallurgical process in the mold, it is mandatory that the mold not be directly connected to the inlet nozzle and, therefore, that there be a gap therebetween. However, any escape of molten metal through this gap must be prevented. To this effect, an electromagnetic seal is provided which, according to the present invention, uses a polyphase AC current primary loop integral with the mold for generating forces exercised on the meniscus of liquid metal present in the gap working as levitation and stabilization forces. Through this approach the basic levitation force/ampere relationship at the meniscus location is maximized. Selected amperage and high-frequency excitation is provided through direct and integral electrical collections, with the annular portion of the mold defining the inlet port and serving as a substrate for an induction coil. Such "integral, annular inductor" offers the advantage of perfect continuity, thereby insuring a perfect electromagnet seal, otherwise not attainable with multiphase induction coils and individual electrical connections.

Figure 1:
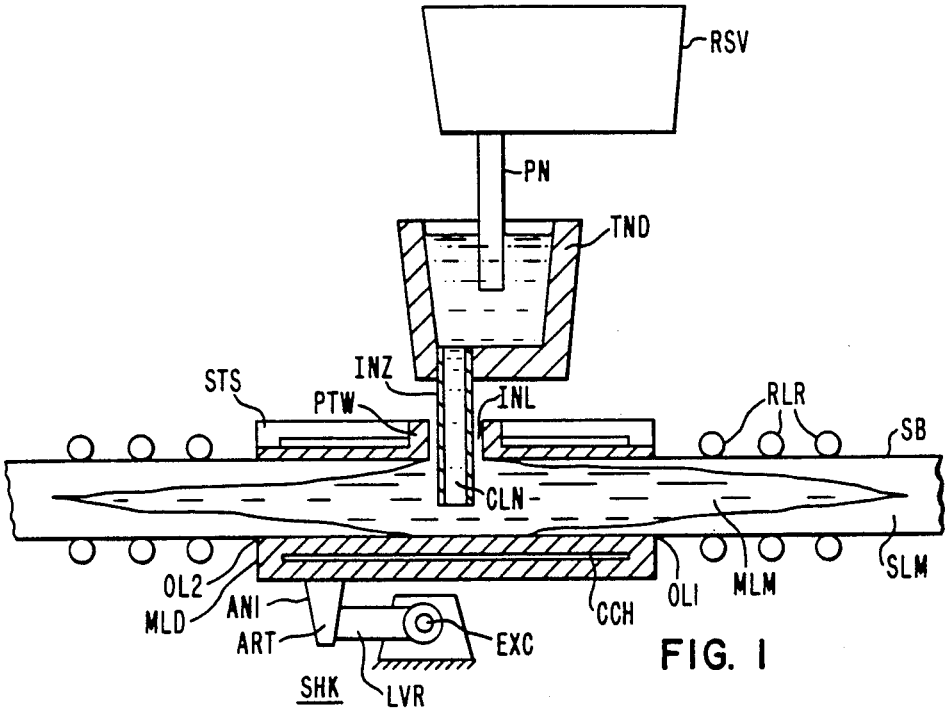
FIG. 1 shows a casting vessel of the prior art adapted for horizontal extraction of solid billets, with horizontal shaking of the vessel about a central and upper inlet nozzle feeding molten metal in the casting vessel.

Referring to FIG. 1, the invention is illustrated with the preferred method of producing billets in modern steel making, i.e., by continuous casting with a tundish TND supplied with molten metal from a reservoir RSV pouring metal through a pouring nozzle PN. The tundish has an open upper side and is provided with a bottom outlet connected to a vertical nozzle INZ surrounded by a central mold MLD, or casting vessel. The mold MLD has a central top inlet port INL defined by the wall PTW which is part of the casting vessel. The mold was within its walls a cooling channel CCH. Typically, the mold walls are made of thermally conductive metal, such as copper. The wall is reinforced outwardly by a steel structure STS as shown in FIG. 1 for illustration. The mold has two lateral and opposite openings OL1, OL2 from which billets of solid metal SB are pulled continuously with a roller RLR.

Metal is being poured continuously from the top, thereby maintaining above the pool of liquid metal MLM in the mold a column of liquid metal CLN above the surface of the pool or bath in the mold. At the same time, solid metal SLM is being extracted through ports OL1, OL2. The solidification process takes place close to the cooled walls of the mold and radially in the core of the billets, as generally known. In order to break loose the rapidly solidifying metal, the entire mold/pool assembly is shaken horizontally by motion at low frequency. To this effect, a shaker mechanism SHR is connected to an anchoring member ANT through a lever LVR having an articulation ART connected to member and through an eccentric EXC fixed to the ground. A drive motor, not shown, turns the eccentric so as to transmit through lever LVR alternative movement at the frequency of the eccentric.

The required oscillation trajectory depends upon factors such as billet dimensions and casting temperatures. Typically, with billets of 6"×6" in cross-section and made of steel, ±⅜" is a typical amplitude of the oscillators. Given such an amplitude, the gap defined between the tundish nozzle INZ and outer surface of the mold inlet INL must allow for a minimum mechanical clearance of ⅜" in order to maintain radially a separation between the two during oscillation of the mold.

With a permanent gap existing close to the surface of the molten metal in the mold, there exists, however, a problem of sealing. Moreover, such seal should counteract the weight of the column CLN of metal in the nozzle. Various means of sealing the inlet nozzle to the inlet port inner surface of the mold have been tried: mechanical sliding seals, elastic or bellows-type seals, as well as high pressure air, or inert gases. The mechanical systems generally develop leaks at the high temperature and high duty cycle involved here. The pressurized air-jet approach introduces air-bubbles into the molten steel, and deterioration of the tensile strength of the finished product ensued. Therefore, the latter approach has been discarded.

Another approach is to use the electromagnetical forces generated in the metal by one or more electrical coils disposed in proximity. Applying a single coil wound around the inlet nozzle and energized with AC current would be providing, for instance, an excitation strength in the range of 50,000 to 100,000 ampere-turns with a frequency in the 100–1000 Hz. range for instance. In account comes the fact that the nozzle inlet diameter should be no greater than 5". Accepting a much reduced performance with economy of manufacture is also conceivable with a 50 or 60 Hz. frequency from the network. These approaches, though, besides the above-mentioned limitations, have a major inherent drawback in that the main reservoir is often rather deep, as much as 26", and the ferrostatic head at the nozzle-mold interface can be on the order of 10 psi. Accordingly, three major obstacles have to be overcome:

1. The magnitude of the levitation or stabilizing force exerted on molten metal in the nozzle region has been too low to counteract typical ferrostatic heads in common use in large commercial casting systems.

2. If coils of the electromagnetic system are of the multiple-turn type, this necessitates electrical insulation, or air-space between turns which entails a very limited lifetime due to the extremely high temperatures and corrosive environment that surrounds the coils.

3. Further such multiple-turn coils require that either an inlet or an outlet electrical conductor be run vertically down the coil side. This poses a layout problem for the design of the mold. If a discrete coil arrangement is chosen, this requires that an external mechanical frame support the coil system and further that electrical insulation between the coil and mold be provided. As a result, the vertical distance between the bottom of the most lower coil conductor and the melt meniscus may become unnecessarily large, thereby reducing the electromagnetic pressure considerably.

It is desirable, though, to have an inductor integral with the mold since the current path becomes concentrated along an extremely robust and compact path disposed as close as possible to the molten metal and without the need for inter-turn or coil to mold insulation.

Moreover, the excitation current in such a situation is equal numerically to the total ampere-turns, e.g. 100 K.A.T. in such a situation with this arrangement the input and output lead may be made also part of the mold casting until a point where they are brought out to a flexible, stranded cable at a location where greater room is available outside the narrows of the nozzle region.

Another advantage resides in that the optimum material for the current path, which is copper, is also the optimum material for the part of the mold immediately around the nozzle due to the need to remove heat rapidly. However, care must be exercised in the design, especially for high-frequency use, since current distribution in the mold position will not necessarily be uniform but tend to concentrate toward the top outer surface rather than, preferably, at the bottom section.

Figure 2:
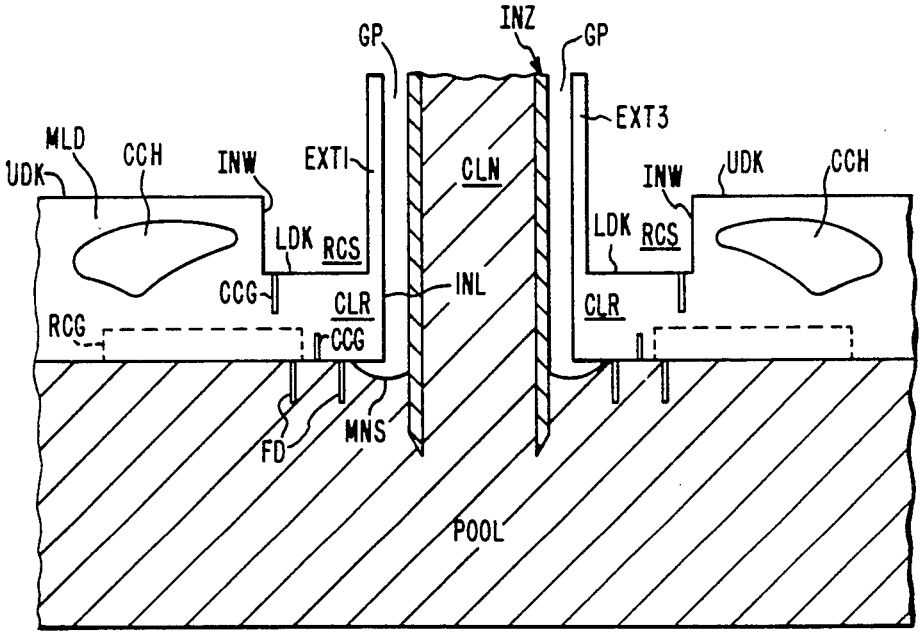
FIG. 2 shows the integral inductor according to the invention which is part of the inlet port of the casting vessel for the column of molten metal fed therethrough with a nozzle.
Figure 3:
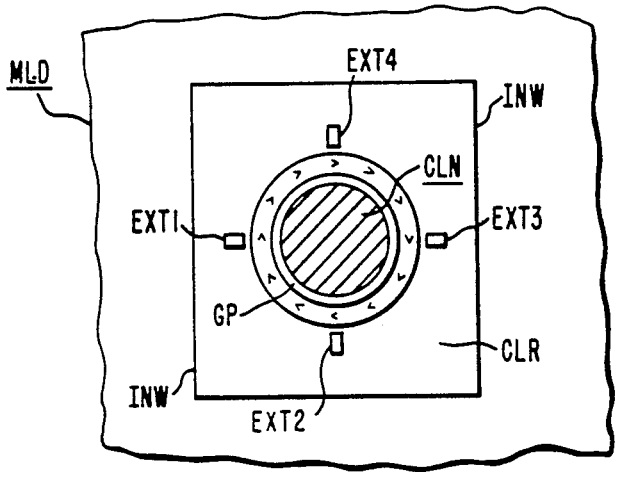
FIG. 3 and FIG. 4 show the integral inductor of FIG. 2 excited with a two-phase and a three-phase electrical supply, respectively.

According to the invention, this idea is implemented as illustrated in FIG. 2. A nozzle INZ disposed below the tundish maintains a column of molten metal CLN above the upper surface of the pool in the mold MLD. A meniscus MNS extends between the outside wall of the nozzle and the upper inner surface of the mold near the edge of the inlet INL. A gap GP is maintained therebetween. Extraction of solidified metal is effected horizontally as shown in the molten metal by opposite arrows, according to the illustration of FIG. 1. According to the present invention, the upper wall of the mold through which the inlet is provided has a recess RCS taken out of the overall thickness, thereby defining an inner wall INW and a lower deck LDK. The inlet is defined through the thinner portion. The material used for the mold wall is of thermally conducting material, preferably of copper. FIG. 3 shows the low deck seen as a square recess in the upper deck UDK of the mold. At EXT1, EXT2, EXT3 and EXT4, three integral portions of conducting material are shown extending upwards along the edge of the gap at four symmetrically disposed locations. In FIG. 2, only extensions EXT1 and EXT3 are shown in diametrically opposed relationship. Extensions EXT2 and EXT4 are not shown, but, it is understood, that they are disposed in a transversal plane and symmetrically. These two pairs of extensions are used as leads for alternating current from a two-phase AC system. For instance, phase A to EXT1 and EXT3, phase B to EXT2 and EXT4. Therefore, an inductor is provided integral with the mold which is annular and continuous along the entire gap. Current path is provided through the inductor to generate circumferential stirring of liquid metal around the nozzle and exerting containing forces on the meniscus preventing a leak.

Figure 4:
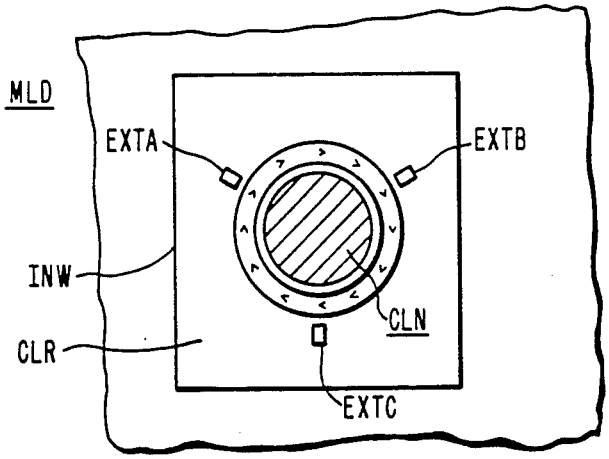

FIG. 4 shows a preferred embodiment of the invention. The polyphase AC current supply is a three-phase, three-wire system. Three extensions are provided EXTA, EXTB, EXTC arranged in a triangular and symmetrical way for the respective phases A, B, C. The gap GP, typically is ⅜ of an inch. The explanations given hereinafter apply not only to the embodiment of FIG. 3, but also to the embodiment of FIG. 4. More generally they should be considered within the broad concept of an integral inductor surrounding the gap on the mold side thereof.

As shown in FIG. 2, a coolant channel CCH is provided in the wall of the mold nearby the recessed area RCS, thereby providing cooling for the inductor. In order to overcome the risk of stray current paths in the metal, which would alter the desired field concentration pattern, annular grooves CCG are formed in the copper mass of the integral inductor CLR. These grooves are annular, long and narrow cuts, or slits, in the upper deck of the recess RCS as well as below in the surface, or ceiling of the mold vessel, as shown in FIG. 2. These slits are displaced from one another radially and disposed a predetermined distance from the operative zone of the inductor, namely the zone bordering the edge of the gap. Ideally, the current should be confined to an annulus of very small radial thickness surrounding the nozzle right above the meniscus. In practice, each planar dimension of the cast integral inductor is at least ten times the nozzle diameter, as shown in FIGS. 3 and 4. Therefore, unless preventive measures are taken, such as with the aforementioned slits CCG, a substantial current density would exist two inches from the nozzle inlet INL, radially.

At low frequency, the current path is easily confined, due to the overwhelming prevailing importance of the resistance of the mold which determines the current paths. However, at medium range frequency, for instance, above 100 Hz, mold inductance and skin-effect play an increasing role in determining current density distribution. For this reason, directional slits like CCG are provided to overcome the adverse effects of skin-effect. In their implementation, it is observed, illustratively, that slits CCG are only partial slits across the thickness of the integral inductor mold portion. Their depth is a fraction of the mold wall thickness, and their width is machined to be as narrow as production tolerances permit, e.g., 0.5 cm. Such current-confinement grooves may be of two types: (1) grooves machined circumferentially at progressively increasing radii from the nozzle inlet as previously described, or/and (2) groove machines in a radial direction from a radial distance of several millimeters from gap GP. In the preferred embodiment of FIG. 2, two circumferential grooves CCG are provided: one in the upper and one in the lower surface of the inductor, typically 10 mm. deep in relation to an outer surface for the inlet port INL of 127 m/m. diameter. The grooves have an accordion configuration due to their opposite relationship between the upper and lower surfaces at different radii. The width of each groove CCG being about 0.5 mm, each slit may be packed with an electrical insulating material, and high temperature powder, such as boron-nitride, thereby to maintain the mechanical integrity of the mold in the integral inductor portion thereof.

In addition to the circumferential grooves CCG, radial confining grooves RCG are provided as shown in dotted lines. The overall effect of the latter groove is to increase the circuit resistance for stray currents much in the same fashion as laminating sheets of steel in conventional rotating machines. However, in this instance, the current are not induced eddy currents, but rather currents generated by direct conduction through the rim of the mold about the inlet port INL.

Another feature of the present invention is the provision of flow directors which are also effective in confining the polyphase current in the integral inductor. These flow directions appear as FD in FIG. 2. They are mechanically connected to the under surface in a zone defining circumferentially the effective zone of the integral inductor. Thus, flow directors ED are minimized in the molten metal of the pool. Their function is to insure that the induced current in the melt remain concentrated about the area of the meniscus, thereby assisting in obtaining the best levitation efficiency for a given primary current flowing in the integral inductor. Flow directors FD are preferably of non-ferromagnetic, non-conducting high-temperature material.

Still another feature with the integral inductor according to the invention is the provision of ferromagnetic flux concentrators illustrated at FMC (below the meniscus in the circuitry thereof and immersed in the liquid bath), and at FML (provided as a sleeve around the inlet nozzle INZ). All materials in the immediate vicinity of the nozzle region are non-ferromagnetic. The molt castings are typically manufactured from copper, the support structures are stainless steel melt being always well above the Curie temperature and thus steel in these applications is non-ferromagnetic. However, provision is made to improve the polyphase levitation through the incorporation of ferromagnetic materials selectively so as to cause a local increased concentration of field density. These ferromagnetic materials may be carbon-steel pole pieces or sleeves. As illustrated in FIG. 3, they are preferably located in two places: (a) FML surrounding the basic nozzle inlet wall (usually composed of a ceramic or boron-nitride material) and oriented vertically; (b) FMC underneath the copper mold, preferably directly supported by the mold upper wall, and circumferentially disposed.

The first type of flux concentrator (FML) is acting as a shield to prevent magnetic flux from entering the main nozzle, preventing the strong magnetic fields from pinching off, or intermittently interrupting the continuous flow of liquid metal. This sleeve should have a vertical length nearly equal to that of the original inlet nozzle, with the exception that the ferromagnetic sleeve need not extend into the melt beyond the depth at which it passes the bottom surface of the main mold. The dimensioning of the radial thickness of this structure is such as to ensure that the magnetic permeability of this addition remain high under all probable excitation conditions. Although permanent magnets offer possible advantages as flux concentrators, the temperatures involved in all regions of the continuous caster prohibit the use of permanent magnet rare-earth materials due to the demagnetization effects which occur at high temperatures.

Figure 5:
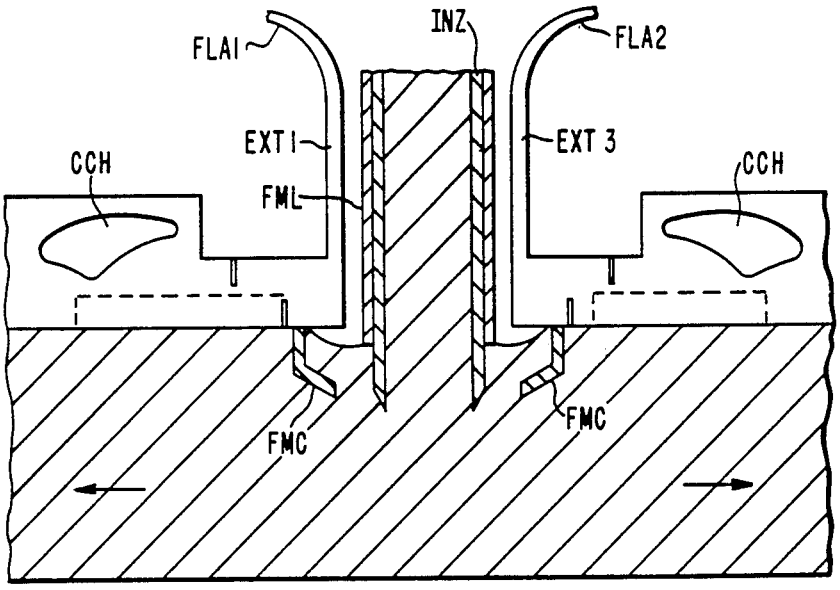
FIG. 5 shows the integral inductor of FIG. 2 with additional features for its implementation.

FIG. 5 also shows flexible leads FLA1 for electrode EXT1, FLA2 for electrode EXT3. They are relative to the common phase A of the di-phase system of FIG. 3. It is understood that similar flexible leads are provided for the two electrodes EXT2, EXT4 (FIG. 3) with respect to the other phase B.

It is observed that the cooling channel of the mold, being in proximity to the integral inductor and taking advantage of the good thermal conductivity of copper, for instance, serves also as a cooling channel for the integral inductor.

The present invention applies to two, three or more phases of a polyphase current source connected to the integral inductor. The basic configuration provides a circuit path which is integral with the main cooling mold in all respects and no electrical insulating material is used in any of the integral inductor pieces. It appears that the following results are achieved:

(a) A rotating magnetic field, circumferential in direction, is established in the liquid metal meniscus due to the incorporation of polyphase excitation, instead of a stationary field varying in magnitude as would licensing a prior art coil.

(b) Due to the presence of the rotating field pattern, there are no null-field points under any of the input current leads. This continuity of the annular inductor assures for the melt a uniform mixing and stabilizing force.

(c) With a multi-phase system it follows that the line-current per conductor, or lead, is reduced for a given levitation force. The advantage of this, in the high-current systems is that it alleviates or reduces the problem of sufficient heat transfer/cooling at the mold-input lead interface, since current collection is spread out over a larger area.

(d) The polyphase-layout described hereabove for the integral inductor is directly compatible, is a preferred one and is optimum for the use of high-frequency electrical alternators providing all of the excitation. In contrast, a single-phase alternator (or only 1 phase of a polyphase unit) is technically feasible but the overall power/weight ratio of a single-phase alternator is substantially lower than the equivalent KVA polyphase-alternator. An alternative to utilizing a polyphase-alternator would be to use a polyphase solid-state power converter where, again, the lowest capital cost is obtained with a polyphase converter for a given KVA due to present standardization and market conditions of the industry.

Polyphase levitation is effected with any number of phases greater than one. Specifically, the preferred number of phases are two, three, six, twelve and fifteen, whereby the corresponding number of leads and input connectors would be four, three, six, twelve and fifteen.

The selection of the frequency of excitation is flexible but it should be noted that the available network frequency is not adequate for the majority of steel melts due to the high volume resistivity (120 μΩ-cm at 1200° C.) of the material in the mold. Nevertheless, other materials, such as aluminum could possibly accept 50 or 60 Hz systems with sufficient levitation pressure. At the present time, however, continuous casting systems do not focus on aluminum production. The dominating factors when deciding of the optimum excitation frequency are, first the melt resistivity and second, the diameter of the nozzle port of the meniscus, since this establishes the electromagnetic pole-pitch of the field. As a general guide to determining minimum frequency constraints, as high a magnetic Reynold's number, since possible should be adhered to as:

$$R = \frac{2\,T_p^2\,\mu_o f}{\rho s\,\pi\,g} \tag{1}$$

where $T_p$ is the pitch or mean diameter of the coil (approximately the same as the meniscus diameter), $\mu_o$ the permeability of free-space, f the excitation frequency in Hertz, $\rho_s$ the surface resistivity (in ohms) of the melt upper surface, and g is the electrical induction air gap (vertical) or distance of separation between the mean plane of the coil and the upper melt surface. All units should be in m.k.s. system for evaluation and a magnetic Reynold's number must be greater than 1.0 to produce any type of normal or levitation force on the melt irrespective of the ampere-turns involved.

Equation (1) determines that the proper frequency should change linearly with melt resistivity and also determines that if a mold inlet nozzle is double in physical size (such as diameter), then the minimum frequency for levitating may be reduced to a quarter of the previous value. The Reynold's number is dimensionless. Generally if $R<1.0$, it is impossible to produce stable levitation. However, the present invention intrduces an electromagnetic factor not encountered with the prior-art owing to the polyphase excitation of the integral inductor.

The involvement of in-mold stirring action under the present invention may be assessed and described in terms of the net electromagnetic slip that the molten liquid is experiencing. The per-unit slip is defined as:

$$S = \frac{v_s - v_r}{v_s}$$

where $v_s = \pi D$ f is the synchronous field speed for D the mean diameter of the coil or meniscus f the electrical frequency of excitation. The actual linear velocity of the melt is $V_r$ usually expressed in terms of meters/-second. An important feature is that, due to the need to keep excitation frequency high enough to yield a high Reynold's factor, the corresponding synchronous field speed is typically very high, an effect which is also attributable to the relatively large nozzle diameters. The net effect is that the per-unit slip is at all times closer to unity than for most induction, polyphase coils. Conventionally these tend to maintain the slip as close as possible to zero under efficiency and power factor considerations. However, for continuous casting applications, a very large slip is preferably as a preliminary condition for stable levitation. More important than maintaining a high Reynold's number, the slip-Reynold's number product according to the described invention, must be greater than unity for stable levitation. Therefore: $s \cdot R > 1.0$ is a stable location, whereas $s \cdot R < 1.0$ is an unstable location. The underlying factors that ultimately contribute to the net slip are: (a) the viscosity of the liquid metal at the surface, and (b) the ferrostatic pressure head on the incoming liquid metal.

In assessing a practical, full-scale version of the described invention, assuming the meniscus diameter to be D=0.127 m (5 in.) and the frequency 1000 Hz, the synchronous field speed is 398 m/s. This is at least an order of magnitude faster than the melt rotating speed. If the mechanical power required to rotate the melt at speed $V_r$ for just the melt (which is, by example, one skin-depth deep) is $P_m$ (watts), then the appropriate slip is, theoretically:

$$S = \frac{P_r - P_m}{P_r}$$

where $P_r$ is the electrical power dissipation in the top layer of liquid metal due to ohmic heating. In this example, the magnitude of $P_r$ may be 10 KW for a 5 inch nozzle inlet and a 60 K.A.T. excitation in the primary coil/casting. It is estimated that the stirring power, $P_m$ would be of the order of 0.1 KW, which dictates that the slip is approximately 99%. The speed of the melt can be no greater than 3.9 m/s on the basis of the original estimate for the magnitude of $P_m$. This explains why for the described invention it is necessary that $sR > 1.0$ and, therefore, $R > 1.0$.

The following considerations are of importance in understanding the operation of the integral inductor according to the invention. Consideration is first given to the lowest operative frequency compatible with a particular continuous casting application.

The lowest frequency permissible is largely a function of the (a) inner diameter of the coil and (b) the resistivity of the melt at its operating or outer surface temperature. In general the minimum frequency can be calculated from the "Laithwaite's factor".

$$R_{min} = G_{min} = \frac{2T_p^2\,\mu_o t\, f}{\rho_r\, g_e\, \pi} \text{ (dimensionless)} \quad (1)$$

where f=frequency in Hertz, $\mu_o$ is the free space permeability ($4\pi \times 10^{-7}$), $g_e$ is the radial airgap between the inner edge of the EM coil and the outer edge of the melt in meters, the quotient $P_r/t$ is the effective surface resistivity of the melt in Ohms, and $T_p$ is the pole-pitch of the rotating field device which, in this disclosure, would be equal to simply the quantity [Inner coil diameter$\times\pi$]/2 in meters. To calculate the lowest critical frequency for levitation effects, $G_{min} \sim 30$ while using the resistivity of aluminum as an example at a minimum temperature of 659° C. (melt. temp), the basic resistivity is 9.23 micro-Ohm-cm (which yields a surface resistivity of $10.45 \times 10^{-6}\ \Omega$ for $P_r/t$ using an iterative process) and the skin depth in the aluminum is estimated as $< 8.83 \times 10^{-3}$ m. (at a frequency of 300 Hz). Substituting these in Equation (1), it is found for a pole pitch of 0.219 m. (5.5 in. inner diameter of the coil), $$R_{min} = G_{min} = \frac{2(.219)^2\,(4\pi \times 10^{-7})}{(.0095)(10.45 \times 10^{6})\pi} F_{min} = 0.386\, F_{min}$$

Thus for minimum levitation effects, $F_{min} \sim 30/0.386 = 77.7$ Hz for the best possible situations, with an excellent conductor such as aluminum, and assuming a 5.0 in. diameter inlet nozzle to the caster. The frequency 300 Hz is to be used as critical minimum frequency since the majority of metals would require at least this frequency due to their inherently poorer conductivities.

Considering now the highest operative frequency compatible with a particular continuous casting application, the following remarks are in order:

By the same process, the highest critical frequency can be found by using a metal with a poor conductivity at a very high temperature and assuming a 3000 Hz. factor in skin depth in the metal. Again, it is advisable to use a pole pitch of 0.219 meters and an airgap $g_3$ equal to the mechanical oscillation of $\frac{3}{8}$ in. or 0.0095 meter. However, as an upper limit on Laithwaite's number, $G_{max} = 100$ because beyond this the increase in levitation is negligible. For example, if using manganese steel at 1260° C., the melting point, the volume resistivity is 156.8 micro-Ohm-cm; the skin depth is 1.15 cm and thus the surface resistivity is $136 \times 10^{-6}$ Ohms.

Therefore:

$$G_{max} = 100 = \frac{2(0.219)^2\,(4\pi \times 10^{-7})}{(0.0095)(136 \times 10^{-6})\pi} F_{max} = 0.0297\, F_{max} \quad (2)$$

Thus in the worst situation, $F_{max} = 100/0.0297 = 3{,}367$ Hz for a material such as manganese steel.

A distinction also is to be made between a high frequency current applied to the integral inductor according to the invention which is effective in sealing the gap spun by the meniscus of a continuous casting vessel and high frequency induction heating effect.

The primary purpose is to provide a sealing effect with the consequent induction heating being an undesirable side effect. One elementary way of evaluating the efficiency of this device would be to express the ratio of [sealing force—synchronous field speed] product calculated in "synchronous watts" to the total ohmic heating power losses in the melt. The way to maximize this efficiency is to use (if possible) a melt with a low surface resistivity such as aluminum. In theory, with a perfect molten conductor that had zero resistance; the levitation efficiency would be 100%. In general, liquid metal EM confinement systems use different metals and/or frequencies, but if they are able to have equivalent Laithwaite Factors, then they will have a constant ratio of sealing force synchronous watts to ohmic heating losses. The higher the factor G as given in equations 1 or 2, the higher will be the per unit sealing effect.

With regard to matching the induction "coil" so as to be influenced by the gap, there is little matching required with the integral inductor according to the invention. In contrast, with other situations, the designer has to opt for as large a Laithwaite factor as possible. Usually this means having as large a coil inner diameter as possible and, to a lesser extent, usually means also having as high a frequency as in convenient to build a supply for. There is no matching of the coil ohmic losses to the melt ohmic losses as in conventional induction machinery. Instead the coil ohmic losses must be designed for the absolute minimum irrespective of the melt surface resistivity. The main precaution is that if frequency is increased, the skin depth has to be figured and used to determine the effective surface resistivity of the melt for use in Laithwaite's Factor, which is general ratio of magnetization current to melt eddy-currents.

Figure 6:
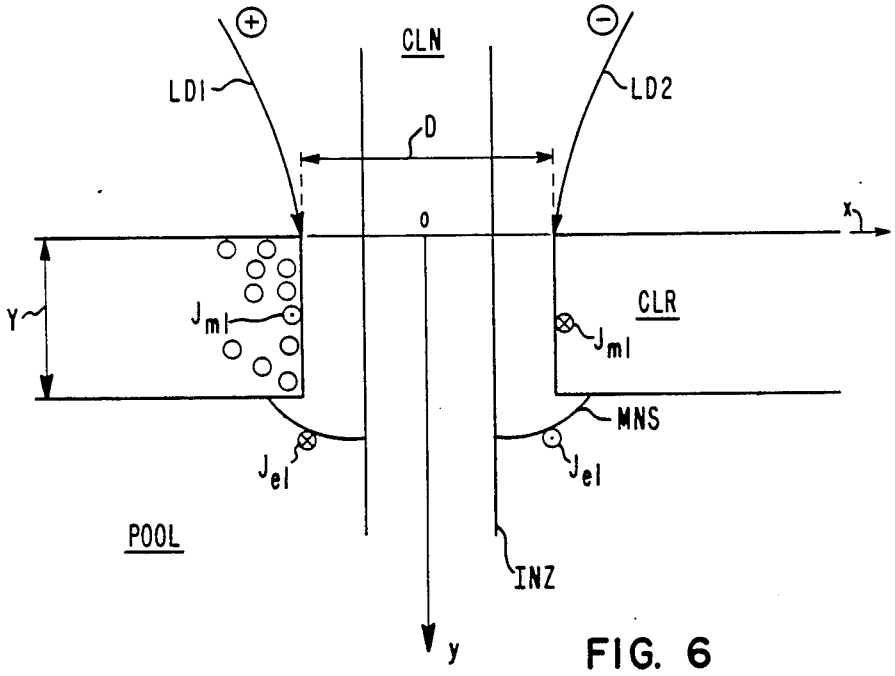
FIG. 6 shows schematically the interaction between current in the integral inductor and eddy-current below the meniscus in the gap between inductor and nozzle.

Referring to FIG. 6, the induced electro-magnetic forces in the pool of molten metal include (1) the normal levitation force and (2) the tangential rotational force exerted on the elementary eddy current doublet mobile in the pool. FIG. 6 shows in the form of bubbles the circular trajectory of current induced by the two leads LD1 and LD2 of opposite polarities applied on the edge of the integral inductor, it being assumed to be ideally reduced to a planar coil along the edge of the gap GP. At $J_{mi}$ is shown the most central current assuming a gausian distribution in the mass of the integral inductor. Similarly, eddy currents are generated along the meniscus MNS in the pool. Shown as a bubble is the circular eddy current $J_{el}$ most centrally located. Also according to a gaussian representation, $J_{ml}$ and $J_{el}$ both admit a common axis the vertical of which is the axis oy of the metal feed column CLN. Transversely thereof is the horizontal axis ox.

Figure 7A:
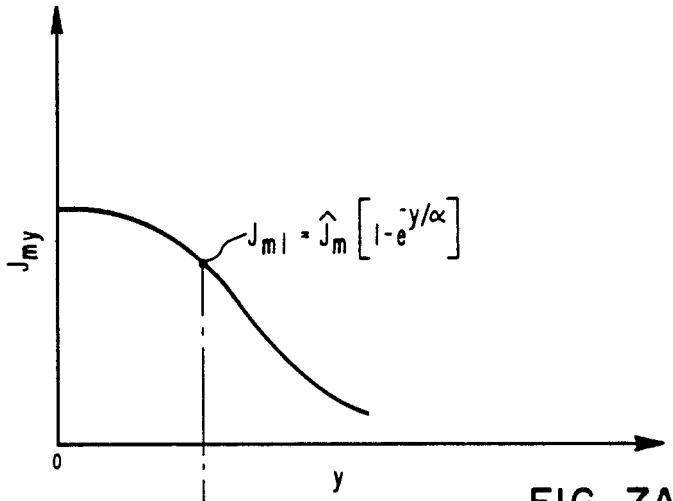
FIGS. 7A and 7B are curves characterizing the induced vector as a function of vertical position and of radial portion, respectively.
Figure 7B:
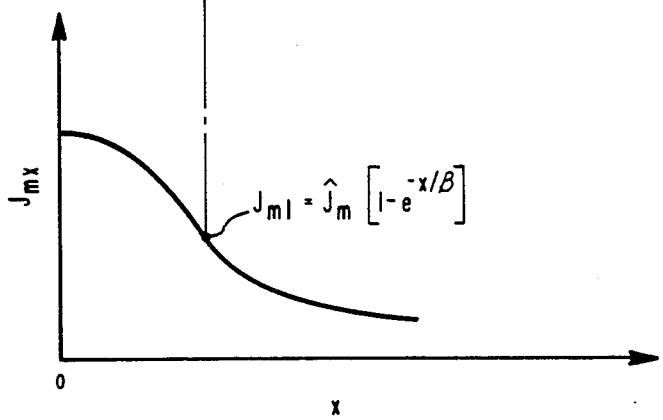

Referring to FIG. 7A, the value of $J_{my}$ is $J_{ml}=J_m[1-e^{-y/\alpha}]$ for the value of y, defined along the axis oy. The curve of FIG. 7A shows the progression of the value of $J_{my}$, the meniscus current induced in the inductor as a function of the vertical portion. Similarly, FIG. 7B shows the value of $J_{mx}$, as a function of the lateral distance from the column CLN axis which is: $J_{mx}=J_{ml}=J_m[1-e^{-x/\beta}]$. $\alpha$ and $\beta$ are two coefficient depending upon the voltage between leads LD1, LD2, of the diameter D of the inductor and of the thickness Y of the inductor.

Typically, the vertical attenuation constant $\alpha$ is 0.005 m., and the radial attenuation constant is $\beta=0.01$ m. $J_m$ is an ampere per square m/m. The pole pitch of the inductor is larger or equal to $D\,\pi/2=T_p$. The efficiency for the circles shown as $J_{ml}$ and $J_{el}$ is $J_{el}/J_{ml}$. The remark can also be made that of the two forces exerted on the liquid in the pool, the levitation and the rotational one, the first prevails at high frequency, while the second prevails at low frequency. It is the levitation force which is desirable with the integral inductor according to the invention, since the vertical forces exerted under levitation tend to maintain the meniscus down despite the forces applied by the column of liquid metal in column CLN. In addition, there is a prior legicated frequency range having a maximal value for such levitation force on account of other prevailing factors, such as the viscosity of the metal, the temperature, and the induction heating effect.

We claim:

1. Continuous casting apparatus including a casting vessel having an upper wall and a lower wall made of thermally and electrically conductive metal, at least one outlet for extracting solidified metal therefrom and an inlet for admitting molten metal therein said inlet being defined in the upper wall and forming a rim therewith;

a feeding nozzle sunk into the molten metal of said casting vessel through said inlet for maintaining a feeding column of liquid metal above said inlet;

said inlet being defined by an annular portion of said casting vessel;

said nozzle and said annular portion defining a gap therebetween;

means being provided for passing polyphase alternating currents through said annular portion to induce eddy currents in the molten metal adjoining said gap;

a plurality of extensions of the same vessel wall metal being formed vertically at regularly distributed locations on said rim, one such extension being provided for a corresponding phase of said polyphase alternating currents, said alternating current passing means being electrically connected to said plurality of extensions;

whereby electromagnetic forces are generated in the molten metal to prevent escape thereof and to maintain said feeding column.

2. The apparatus of claim 1 with cooling channels being provided in the wall of said vessel in proximity to said rim.

3. The apparatus of claim 2 with concentrical circumferential grooves being provided vertically in said for limiting excursions of alternating current radially of said rim.

4. The apparatus of claim 3 with at least two said circumferential grooves being concentrical with said feeding column disposed in opposite sides of the vessel wall and with different radii.

5. The apparatus of claim 2 with a plurality of radial grooves being provided vertically in the proximity of said rim for limiting excursions of alternating current circumferentially in a zone beyond a predetermined radius from the axis of said feeding column.

6. The apparatus of claim 1 with vertical flow directors being provided underneath said rim for confining molten metal mobility within a preferred zone around said feeding nozzle including said gap.

7. The apparatus of claim 1 with programmatic pole pieces being mounted beneath said rim in proximity to said gap and circumferentially about the axis of said feeding column axis for restricting movement of molten metal in a preferred zone about said feeding nozzle including said gap.

8. The apparatus of claim 1 with said polyphase alternating current passing means involving di-phase AC current.

9. The apparatus of claim 1 with said polyphase alternating current passing means involving three-phase AC current.

10. The apparatus of claim 1 with the frequency of said AC polyphase current being in a range between 300 Hz. and 3500 Hz.

11. The apparatus of claim 1 with said casting vessel being shaken horizontally about two extreme positions defined on each side of said feeding nozzle and separated by at most said gap.

* * * * *